US012108878B2

(12) United States Patent
Mazzei

(10) Patent No.: US 12,108,878 B2
(45) Date of Patent: Oct. 8, 2024

(54) BED FRAME

(71) Applicant: EDRA S.P.A., Perignano di Lari (IT)

(72) Inventor: Valerio Mazzei, Ponsacco (IT)

(73) Assignee: EDRA S.P.A., Perignano di Lari (IT)

( * ) Notice: Subject to any disclaimer, the term of this patent is extended or adjusted under 35 U.S.C. 154(b) by 494 days.

(21) Appl. No.: 17/424,795

(22) PCT Filed: Dec. 27, 2019

(86) PCT No.: PCT/IB2019/061402
§ 371 (c)(1),
(2) Date: Jul. 21, 2021

(87) PCT Pub. No.: WO2020/136616
PCT Pub. Date: Jul. 2, 2020

(65) Prior Publication Data

US 2022/0117399 A1 Apr. 21, 2022

(30) Foreign Application Priority Data

Dec. 28, 2018 (IT) ..... 102018000021400

(51) Int. Cl.
*A47C 19/00* (2006.01)
*A47C 19/02* (2006.01)
*A47C 19/04* (2006.01)

(52) U.S. Cl.
CPC ..... *A47C 19/045* (2013.01); *A47C 19/005* (2013.01); *A47C 19/025* (2013.01)

(58) Field of Classification Search
CPC ..... A47C 19/00; A47C 19/04; A47C 19/045; A47C 19/005; A47C 19/021; A47C 19/025
See application file for complete search history.

(56) References Cited

U.S. PATENT DOCUMENTS 4,788,727 A * 12/1988 Liu ..... A47C 27/085 5/177
5,613,253 A 3/1997 Rose
(Continued)

FOREIGN PATENT DOCUMENTS

| | | |
|---|---|---|
| BE | 726465 | 6/1969 |
| CN | 107752553 | 3/2018 |
| DE | 29620819 | 1/1997 |

OTHER PUBLICATIONS

International Search Report Dated Feb. 18, 2020.
(Continued)

*Primary Examiner* — Fredrick C Conley
(74) *Attorney, Agent, or Firm* — Preston Smirman; SMIRMAN IP LAW, PLLC

(57) ABSTRACT

The bed frame (100) comprises a first and a second transverse element (1, 2), made of metal having a box shape, respectively arranged close to the headboard (10) and the front head (11) of the bed (L), mutually connected by a pair of longitudinal elements (6). Said first and second transverse elements (1, 2) support bed joineries (8, 9), arranged inside the aforementioned longitudinal elements (6), suitable to act as spacers to support a bed base (12) on which the mattress (M) of the bed (L) itself is placed. By appropriately calibrating the height of the bed joineries (8, 9), which are interchangeable, according to the greater or lesser thickness of the mattress (M), it is obtained that the height from the ground of the upper horizontal side (20) of the latter, as well as its protrusion with respect to the upper edges of the longitudinal elements 6, are almost constant.

10 Claims, 4 Drawing Sheets

(56) References Cited

U.S. PATENT DOCUMENTS

| | | | | |
|---|---|---|---|---|
| 11,185,169 | B2 * | 11/2021 | Choi | F16B 12/56 |
| 2005/0120478 | A1 * | 6/2005 | Hofmann | A47C 19/021 5/200.1 |
| 2006/0195983 | A1 * | 9/2006 | Polevoy | A47C 19/021 5/288 |
| 2014/0201915 | A1 * | 7/2014 | Ermalovich | A61G 7/0508 29/434 |
| 2017/0143137 | A1 * | 5/2017 | Bell | G09F 5/00 |
| 2023/0220862 | A1 * | 7/2023 | Xie | F16B 12/56 5/282.1 |

OTHER PUBLICATIONS

Written Opinion of the International Searching Authority Dated Feb. 18, 2020.
International Preliminary Report On Patentability Dated Jun. 16, 2021.
English Abstract of BE726465.
English Abstract of DE29620819.
English Abstract of CN107752553.

* cited by examiner

FIG. 3
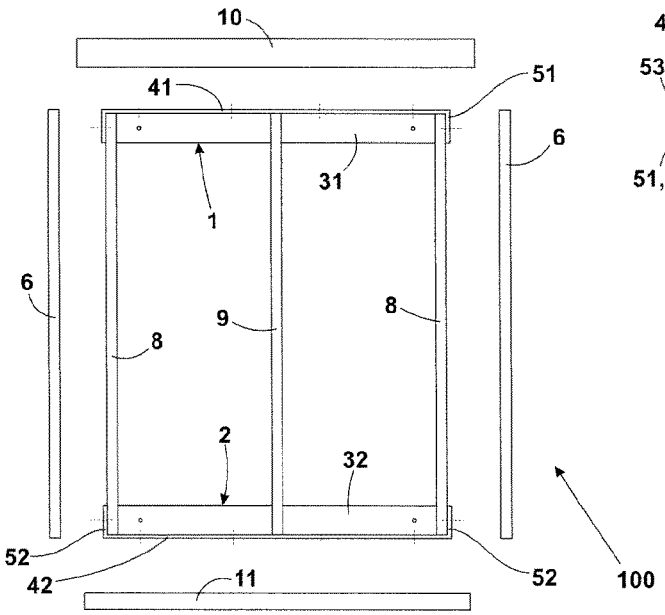
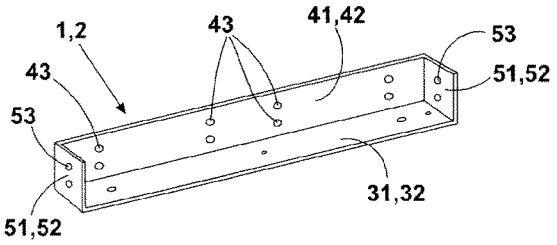
FIG. 4
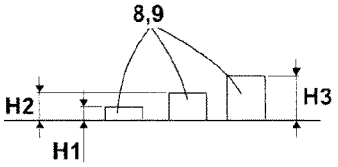
FIG. 5

BED FRAME

CROSS-REFERENCE TO RELATED APPLICATION

The instant application is a national phase of PCT International Application No. PCT/IB2019/061402, filed Dec. 27, 2019, and claims priority to Italian Patent Application Serial No. 102018000021400, filed Dec. 28, 2018, the entire specifications of both of which are expressly incorporated herein by reference.

TECHNICAL FIELD

The present invention is part of the technical sector concerning bed frames, of the type usually used in homes, hotel rooms and similar places.

BACKGROUND ART

Several different embodiments are known for this fundamental home object, according to styles ranging from ancient to modern and with the use of the most disparate materials.

The main constituent elements of a bed are the frame, i.e. the supporting structure, which supports a bed base on which a mattress is laid on.

The bed base can be defined by a more or less sprung metal mesh, or by a series of transverse wooden slats, which are also able to offer a certain elasticity.

In other cases, the bed base is made up of a rigid orthopaedic axis, so that the mattress represents the only yielding element on which the person rests.

The height from the ground of the upper side of the mattress, i.e. the height at which the person lays down to sleep, varies according to the characteristics of the frame and the thickness of the mattress, which is different among the various models.

For some types of beds, e.g. the so-called Turkish ones, perimeter walls are provided, which surround the bed base, extend downwards, to limit the gap from the floor, and upwards, so as to become lateral edges that partially cover the height of the mattress.

The upper side of the mattress must always be a little higher than the upper limit of said perimeter walls, which are rigid and which otherwise could painfully impact the body, both when getting on and/or off the bed and in case of movements during sleep that bring the body close to the lateral border of the bed.

Therefore, for these bed models, it is important that the height of the mattress corresponds to the need to protrude upwards with respect to the aforementioned perimeter walls.

As known, the purchase of the bed and the related mattress is not always contextual, and in any case, it is not uncommon for the latter to be replaced while the bed is not replaced.

When the design of the bed is particularly refined, the overall aesthetic impact cannot be separated from the presence of the mattress and the related linen above it; particularly, it is important that the protruding portion of the mattress is optically balanced with the height of the perimeter walls and/or the rest of the furnishing elements, such as the headboard, if present, and the front head.

In the known construction solutions, the only variable allowed to meet this need consists in the choice of a mattress of adequate height; this obviously represents a drawback both for the manufacturer who wants to offer the complete bed and for the customer in the event that he should change mattress afterwards, since the choice would be limited by this constraint for both of them.

SUMMARY OF THE INVENTION

The object of the present invention is therefore to propose a bed frame that has construction characteristics such as to be able to modify the height of the related base so that the height of the upper side of the mattress can be more or less constant regardless of the thickness of the mattress itself.

Another object of the invention is to propose a bed frame wherein the structural elements are at the same time simple and robust, to be mounted with easy assembly operations, which can also be carried out by the customer himself.

Another object of the invention provides that the peculiar characteristics of the proposed frame are applicable as such for beds of different width, single, queen or double size bed.

A further object of the invention aims to be able to set up double beds, with two mattresses of different thickness having, however, the respective upper sides aligned.

These and other objects are fully achieved by means of a bed frame, of the type comprising a headboard and a front head connected by longitudinal bars, to constitute a support structure for a bed base, with said frame provided with feet, suitable to determine a predetermined height from the ground of the same, and comprising:

- a first transverse box-shaped element, arranged at said headboard, substantially extended over the width of said bed frame and comprising a first horizontal bottom wall, a first vertical wall and two first lateral edges;
- a second box-shaped transverse element, specular to said first transverse element, arranged parallel to the latter and located at the aforementioned front head, at the same height from the ground with respect to the same first transverse element, with said second transverse element comprising in turn a second horizontal bottom wall, a second vertical wall and two second lateral edges;
- a pair of longitudinal elements, extended substantially along the length of said bed frame, arranged perpendicular to said first and second transverse elements, placed from the outside against the respective aforementioned first and second edges and locked to them, to achieve a stable connection between the same first and second transverse elements;
- a first and a second pair of feet, respectively associated with said first and second transverse elements;
- spacer members, of predefined height, removably locked above said first and second horizontal bottom walls of the aforementioned first and second transverse elements, the same spacer members being designed to be interposed between said first and second horizontal bottom walls and an overlying bed base, so as to define for it a predetermined height from the ground.

BRIEF DESCRIPTION OF THE DRAWINGS

The characteristics of the invention will become apparent from the following description of a preferred embodiment of the present bed frame, according to what is proposed in the claims and with the aid of the attached drawing tables, wherein:

FIG. 3 shows a plan view similar to FIG. 1, with bed furnishing elements detached from the frame;

FIG. 4 is an axonometric view of a box-shaped transverse element provided in the frame;

FIG. 5 illustrates the profile of three bed joineries of different heights, designed to act as spacers below a bed base intended to support the mattress;

DESCRIPTION OF THE PREFERRED EMBODIMENTS

Figure 2:
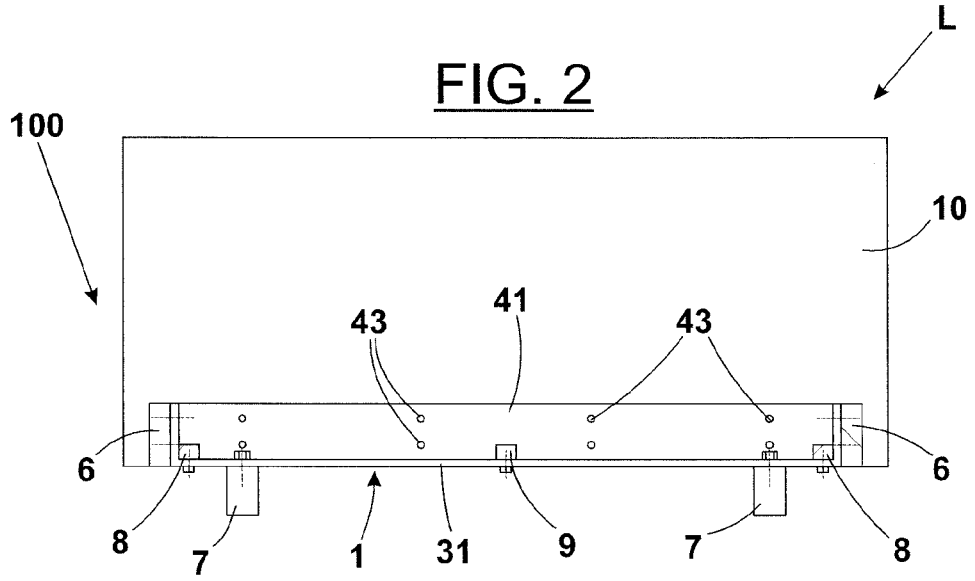
FIG. 2 shows a cross-sectional view of the frame according to the plane II-II of FIG. 1.
Figure 1:
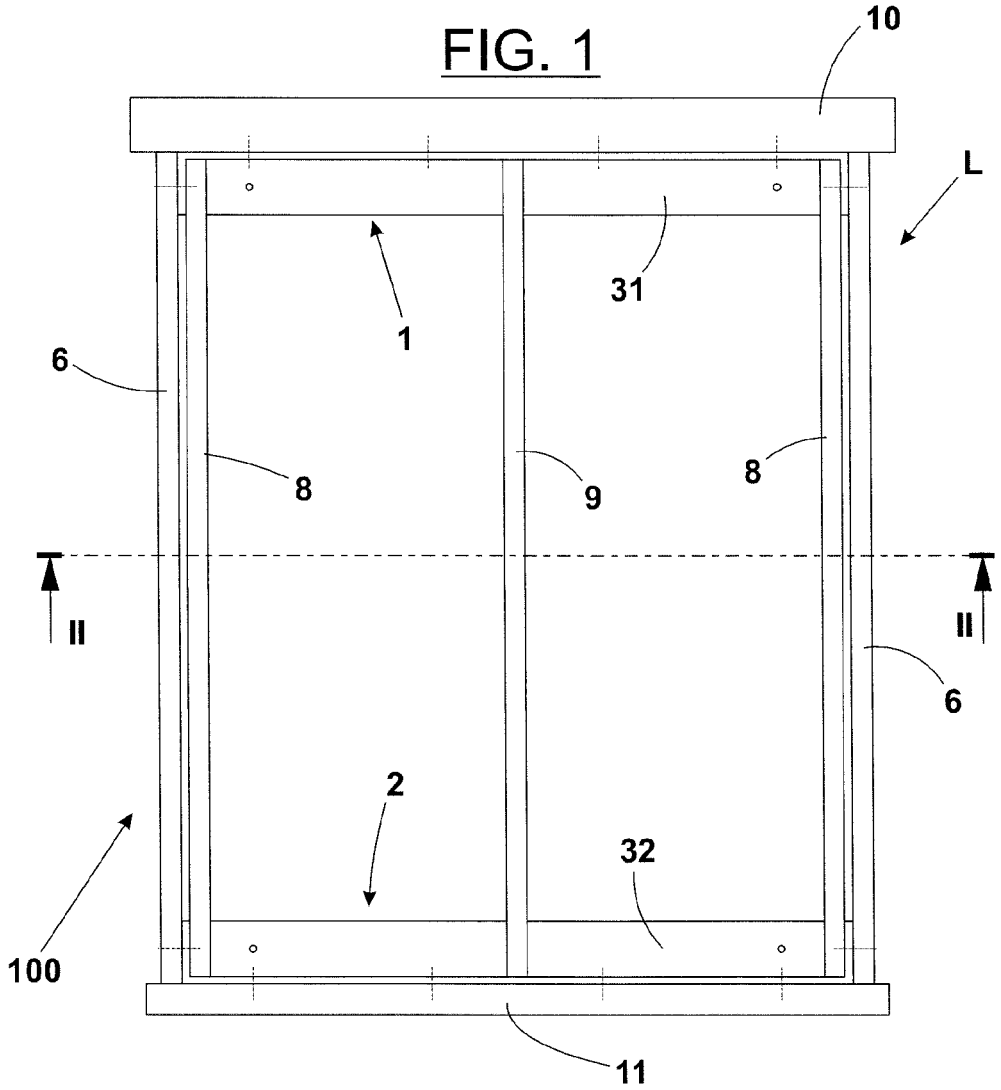
FIG. 1 shows a schematic plan view of a double bed bearing the frame of the present invention.

In the above figures the reference number 100 indicates the frame of the present invention, as a whole, while L indicates the bed comprising the frame 100 itself.

The bed L shown is of the double type, according to a non-limiting example, but obviously the frame 100 can also be associated with a single or queen bed L, as better specified below.

In a manner known per se, the bed frame 100 comprises a headboard 10 and a front head 11 connected by longitudinal bars 6, to constitute a support structure for a bed base 12, the latter defining, in practice, the support plane of a mattress M.

As already mentioned in the premise, the bed base 12, not illustrated in detail as already known, can be defined by a metal mesh or by a series of transverse wooden slats, or even by a rigid orthopaedic axis, preferably a wooden one.

The bed frame 100 comprises two pairs of feet 7, respectively arranged near the headboard 10 and the front head 11, suitable to determine a predetermined height from the ground of the same.

According to the invention, the bed frame 100 comprises a first transverse box-shaped element 1, arranged at the headboard 10, substantially extended over the width of said bed frame 100 and comprising a first horizontal bottom wall 31, a first vertical wall 41 and two first lateral edges 51.

The bed frame 100 also provides for a second box-shaped transverse element 2, specular to the first transverse element 1, arranged parallel to the latter and located at the aforementioned front head 11, at the same height from the ground with respect to the same first transverse element 1.

The second transverse element 2, like the first one, comprises in turn a second horizontal bottom wall 32, a second vertical wall 42 and two second lateral edges 52.

The transverse elements 1, 2 are preferably made with a metal angular profile wherein the respective horizontal bottom walls 31, 32 and the vertical walls 41, 42 are defined.

The lateral edges 51, 52 are made integral with the lateral ends of the aforementioned angular profile and are advantageously obtained in a single body with the latter, by folding and welding corresponding portions, so as to define for each of the aforementioned first and second transverse elements 1, 2 a respective box-shaped structure.

The first and second transverse elements 1, 2 are stably interconnected, at a suitable distance, from a pair of longitudinal elements 6, substantially extended along the length of the bed frame 100, arranged perpendicular to the same first and second transverse elements 1, 2.

The longitudinal elements 6 are placed against the outside of the first and second edges 51, 52, and locked to them by means of screw members not illustrated in detail, passing through holes 53 suitably provided in the edges 51, 52 themselves (see particularly FIG. 4).

The longitudinal elements 6 are preferably made of wood and have a padded covering 60 each, which affects at least the respective external vertical side and the upper border (see FIGS. 6A-6D).

The furnishing elements which constitute the headboard 10 are advantageously fixed to the first vertical wall 41 of the first transverse element 1, by means of connecting members not illustrated in detail, which include through holes 43 made in the same first vertical wall 41, in which screw members are engaged.

Similarly, the furnishing elements which constitute the front head 11 are advantageously fixed to the second vertical wall 42 of the second transverse element 2, by means of connecting members, which include through holes 43 made in the same second vertical wall 42, in which screw members are engaged.

In some embodiments of the bed L, for aesthetic reasons, it is possible to provide that the front head 11 has the same section of said longitudinal elements 6 and that they are angled coupled to the latter, so as to constitute a continuous perimeter band.

The aforementioned first and second pair of feet 7 are respectively associated with said first and second transverse elements 1, 2, at the corresponding horizontal bottom walls 31, 32 (FIG. 2).

The bed frame 100 also comprises spacer members 8, 9, of predefined height, removably locked above said first and second horizontal bottom walls 31, 32 by means of screw members, not illustrated in detail since of the known type. The spacer members 8, 9 are intended to be interposed between the horizontal bottom walls 31, 32 and an overlying bad base 12, e.g. of the known type referred to above, so as to define for it a predetermined height from the ground.

In a preferred embodiment, shown in the attached figures, said spacer members 8, 9 consist of bed joineries, preferably made of rectangular section metal tubing, extended between said first and second transverse elements 1, 2, parallel to the aforementioned longitudinal elements 6.

In FIG. 5 three sectional bed joineries 8, 9 having progressively increasing heights H1, H2, H3 are illustrated; obviously it is possible to provide for further bed joineries with different heights, according to the needs.

In a variant, not shown embodiment, it is possible to provide for bed joineries 8, 9, also of the same height, suitable to be superimposed so as to vary the overall height. With a bed L having the width of a single or queen bed, not shown, there are at least two bed joineries 8 of identical height, arranged inside said first and second edges 51, 52, near them. With a bed L having the width of a double bed, such as the one shown, and in which the bed base 12 is unique, there are at least three bed joineries 8, 9 of identical height, two bed joineries 8 of which arranged inside said first and second edges 51, 52, near them, and another bed joineries 9 arranged at the longitudinal centreline of the bed L.

Figure 6A:
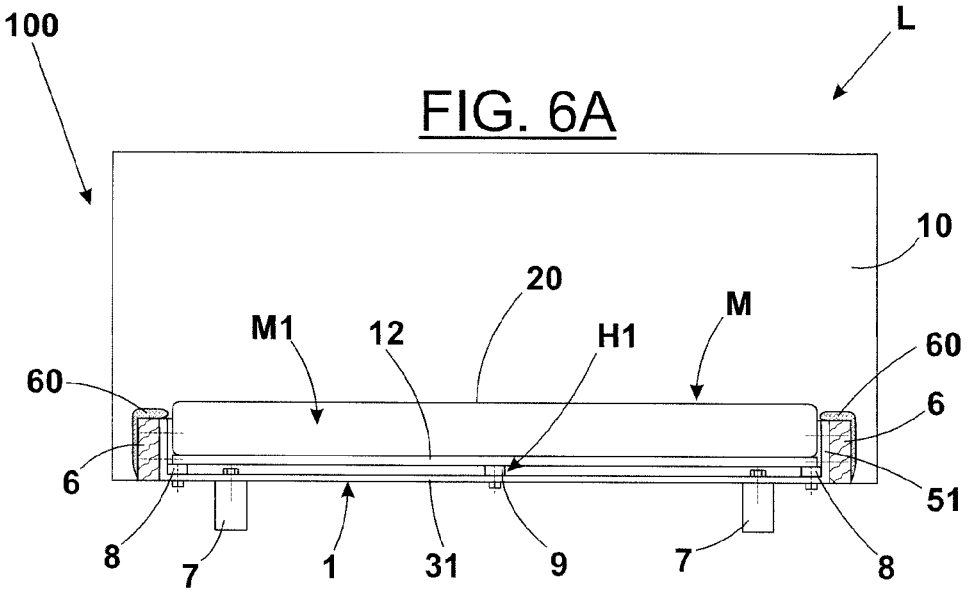
FIGS. 6A, 6B, 6C illustrate sectional views similar to FIG. 2, with the bed base resting on bed joineries of different heights to compensate for different thicknesses of the mattress.

In FIG. 6A a bed L has been illustrated with bed joineries 8, 9 of limited height, e.g. those with height H1 in FIG. 5, suitable for a very thick mattress M1.

Figure 6B:
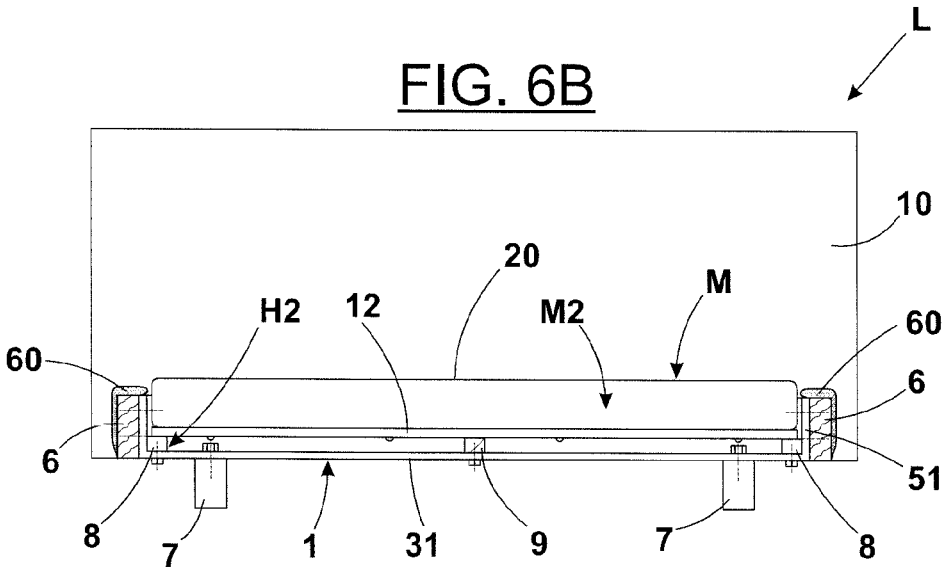

In FIG. 6B a bed L has been illustrated with bed joineries 8, 9 of average height, e.g. those with height H2 in FIG. 5, suitable for an average thick mattress M2.

Figure 6C:
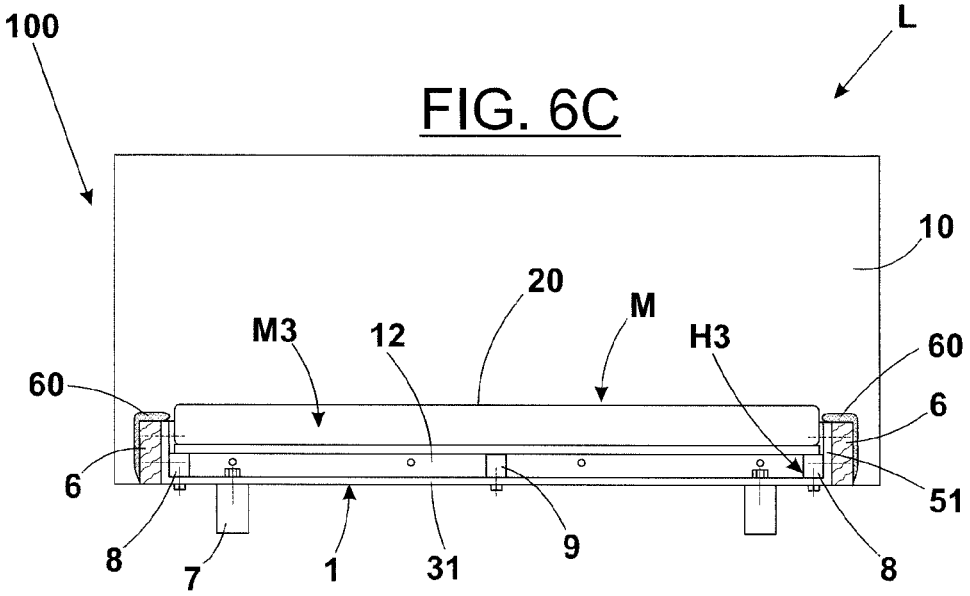

In FIG. 6C, instead, a bed L has been illustrated with bed joineries 8, 9 of higher height, e.g. those with height H3 in FIG. 5, suitable for a limited thick mattress M3.

Figure 6D:
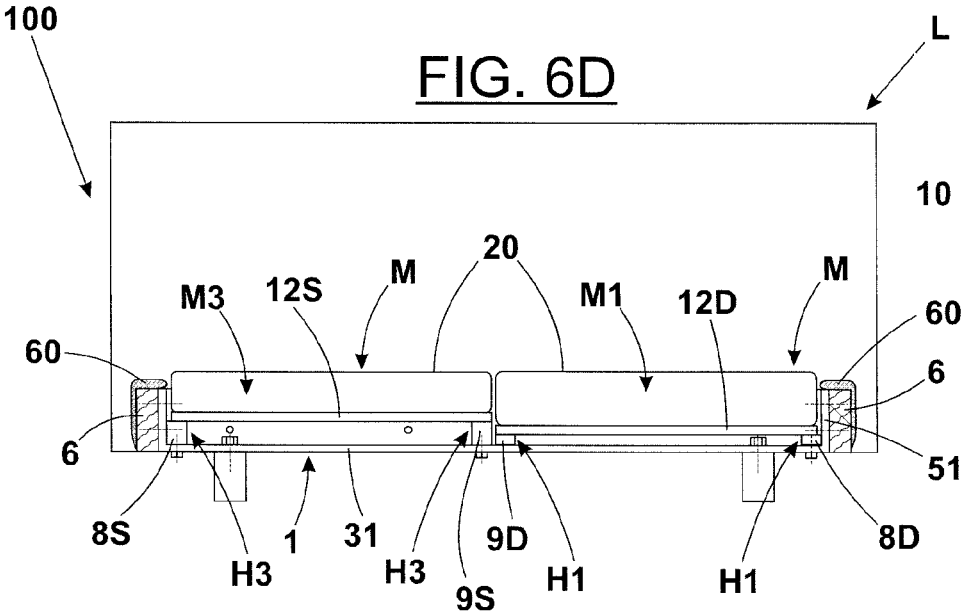
FIG. 6D illustrates a further view similar to FIGS. 6A, 6B, 6C, with the bed base divided into two parts, resting on bed joineries of different heights to compensate for different thicknesses of the two mattresses.

Moreover, in FIG. 6D a double bed L is illustrated, in which the bed base 12 is divided into two side by side parts 12S and 12D, one for each part of the bed; in this embodiment variant, the spacer members consist of two pairs of bed joineries 8S, 9S and 8D, 9D, with the external bed joineries 8S, 8D of each pair arranged inside said first and second edges 51, 52, and with the central bed joineries 9S, 9D arranged substantially side by side at the longitudinal centreline of the bed L. The first pair of bed joineries 8S, 9S, of equal predefined height, e.g. those with the height H3 in FIG. 5, are positioned to support the first part 12S of the bed base 12, on which a single mattress M3 of limited thickness is laid on. The second pair of bed joineries 8D, 9D, having the same predefined height also different from the height of the bed joineries 8S, 9S of the first pair, e.g. those with the height H1 in FIG. 5, are positioned to support the second part 12D of the bed base 12, on which a single mattress M1 of high thickness is laid on.

As seen in FIGS. 6A, 6B, 6C, 6D, the height from the ground of the upper horizontal side 20 of the one or more mattresses M, as well as the protrusion of the same side 20 with respect to the upper borders of the longitudinal elements 6, are constant even if the mattresses M1, M2, M3 have different thicknesses.

The foregoing clearly reveals the peculiar characteristics of the bed frame proposed with the present invention, which, thanks to the interchangeability of the spacer bed joineries, with a simple and rapid operation, allows to suitably modify the height of the bed base depending on the thickness of the mattress to be applied, keeping the height from the ground of the upper surface of the latter constant.

It is necessary to highlight how all the structural elements of the frame are at the same time simple, robust and easy to assemble, ensuring a long lifetime.

As specified in the description, and as easily understandable, the construction characteristics of the proposed frame are applicable for all single, queen and double beds. For the latter, the option of setting up double beds, with two mattresses of different thickness having, however, the respective upper sides aligned is particularly interesting. From the examination of the description and the drawings, it is intuitive to understand how the construction solutions proposed for the present frame have a low production cost. However, it is understood that what described above has an exemplary and non-limiting value, therefore any detail variations that may become necessary for technical and/or functional reasons, are considered from now on to fall within the same protective scope defined by the claims below.

The invention claimed is:

1. A bed frame of the type including a headboard and a front head connected by longitudinal bars, to constitute a support structure for a bed base, with the bed frame provided with feet, suitable to determine a predetermined height from the ground of the same, comprising:

a box-shaped first transverse element, arranged at the headboard, substantially extended over a width of the bed frame and including a first horizontal bottom wall, a first vertical wall and two first lateral edges;

a box-shaped second transverse element, specular to the first transverse element, arranged parallel to the latter and located at the front head, at the same height from the ground with respect to the same first transverse element, with the second transverse element including a second horizontal bottom wall, a second vertical wall and two second lateral edges;

a pair of longitudinal elements, extended substantially along the length of the bed frame, arranged perpendicular to the first and second transverse elements, placed from the outside against the respective first and second edges and locked to them, to achieve a stable connection between the same first and second transverse elements;

a first and a second pair of feet, respectively associated with the first and second transverse elements; and spacer members, of predefined height, removably locked above the first and second horizontal bottom walls of the first and second transverse elements, wherein a first spacer member is positioned in proximity to a first end portion of either the first or second horizontal bottom wall, wherein a second spacer member is positioned in proximity to a second spaced and opposed end portion of either the first or second horizontal bottom wall, and a third spacer member is positioned equidistantly between the first and second space members, wherein the spacer members are configured to be disposed between the first and second horizontal bottom walls and an overlying bed base, so as to define for it a variable predetermined height from the ground.

2. The bed frame according to claim 1, of the type with the width up to a queen bed, wherein the spacer members are made up of at least two bed joineries of identical height, extended between the first and second transverse elements and arranged inside the first and second edges, near them.

3. The bed frame according to claim 1, of the type with the width up to a double bed, wherein the spacer members are made up of three bed joineries of identical height, extended between the first and second transverse elements two of which are arranged inside the first and second edges, near them, and another one is arranged at a longitudinal centerline of the bed.

4. The bed frame according to claim 1, of the type with the width of a double bed and with the bed base separated in two side by side parts, one for each of the parts of the bed, wherein the spacer members are made up of two pairs of bed joineries, extended between the first and second transverse elements, with the first pair of the bed joineries, of equal predefined height, arranged below the first part of the bed base, and with the second pair of the bed joineries having the same predefined height also different from the height of the bed joineries of the first pair, arranged below the second part of the bed base, with the external bed joineries of each pair arranged inside the first and second edges, near them, and with the remaining central bed joineries of the same pairs arranged substantially side by side at the longitudinal centerline of the bed.

5. The bed frame according to claim 1, wherein the first transverse element is made up of a metal angular profile wherein the first horizontal bottom wall and first vertical wall are defined, with the first edges made integral with the lateral ends of the angular profile.

6. The bed frame according to claim 5, wherein the first and second edges of the first and second transverse elements are obtained in a single body with the metal angular profile, by folding and welding the corresponding portions of the latter, to define for each of the first and second transverse elements a respective box-shaped structure.

7. The bed frame according to claim 1, wherein the second transverse element is made up of a metal angular profile wherein the second horizontal bottom wall and second vertical wall are defined, with the second edges made integral with the lateral ends of the angular profile.

8. The bed frame according to claim 1, wherein the pair of longitudinal elements is made of wood and has a padded covering each, which affects at least the respective external vertical side and the upper border.

9. The bed frame according to claim 1, wherein the first and second vertical walls of the first and second transverse elements are provided with connecting members for fixing furnishing elements respectively of the headboard and the front head of the bed.

10. The bed frame according to claim 9, wherein the connecting members comprise through holes made in the first and second vertical walls of the first and second transverse elements, intended to be engaged by screw members.

* * * * *